United States Patent [19]

Gollnick

[11] 4,091,944

[45] May 30, 1978

[54] FRONT END LOADER REFUSE COLLECTION BODY

[75] Inventor: Cyril R. Gollnick, Oshkosh, Wis.

[73] Assignee: Leach Company, Oshkosh, Wis.

[21] Appl. No.: 731,804

[22] Filed: Oct. 12, 1976

[51] Int. Cl.[2] ..... B65F 3/02

[52] U.S. Cl. ..... 214/302; 214/83.3; 298/23 MD

[58] Field of Search ..... 298/23 R, 23 MD, 23 S; 214/302, 303, 83.3, 765, 777, 313

[56] References Cited

U.S. PATENT DOCUMENTS

| | | | |
|---|---|---|---|
| 3,167,195 | 1/1965 | Jensen et al. | 214/302 |
| 3,175,712 | 3/1965 | Herpich et al. | 214/303 |
| 3,237,795 | 3/1966 | Kromer | 214/776 |
| 3,325,216 | 6/1967 | Boeck | 298/23 MD |
| 3,572,529 | 3/1971 | Anderson | 214/302 |
| 3,767,075 | 10/1973 | Leuerenz | 214/DIG. 10 |
| 3,827,587 | 8/1974 | Liberman et al. | 214/302 |
| 3,860,288 | 1/1975 | Martin et al. | 298/23 MD |
| 3,952,890 | 4/1976 | Armstrong | 214/DIG. 10 |

FOREIGN PATENT DOCUMENTS

| | | | |
|---|---|---|---|
| 1,013,135 | 4/1952 | France | 214/765 |

*Primary Examiner*—Lawrence J. Oresky

*Attorney, Agent, or Firm*—Lockwood, Dewey, Zickert & Alex

[57] ABSTRACT

A front end loader refuse collection body for a motor vehicle including vertically movable container lifting arms for raising refuse containers over the body and dumping the contents thereof through an opening in the top of the body. The improvements include a simple mechanical linkage for automatically leveling the fork ends on the container while the arms are being raised. Maintaining the form arms, and the container retained therein, in a substantially level position while lifting the container, eliminates or greatly reduces spillage from the container before it is positioned over the refuse body opening. The improvements further include means for automatically opening and closing the doors covering the top body opening while lifting and lowering the container lifting arms, and a mechanical latching linkage for automatically unlocking and locking the rear door of the refuse body while opening and closing same, respectively.

16 Claims, 14 Drawing Figures

34
33
35
A
53
32
27
31
30
26
25
12
20
51
50
52
36
47
46
19
45
43
42
44
17a
22
20a
41
17
21
14
16
37
40
11
14a
23
14b
24
13
15b
15c
15a
15
10

34
B
A
20
12
17a
36
21
40

FIG. 9
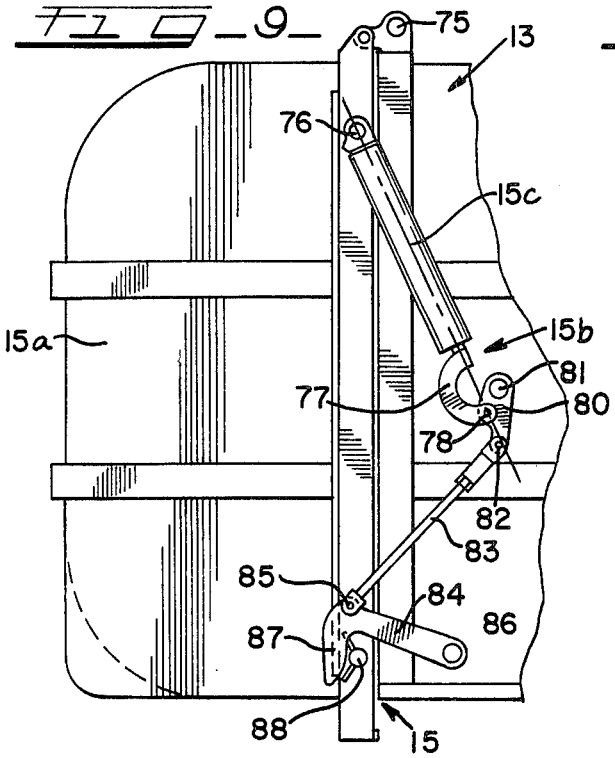
FIG. 10
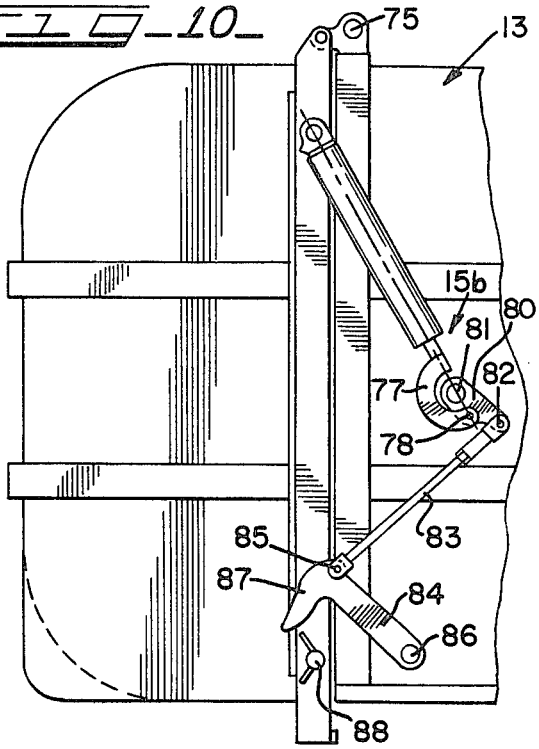
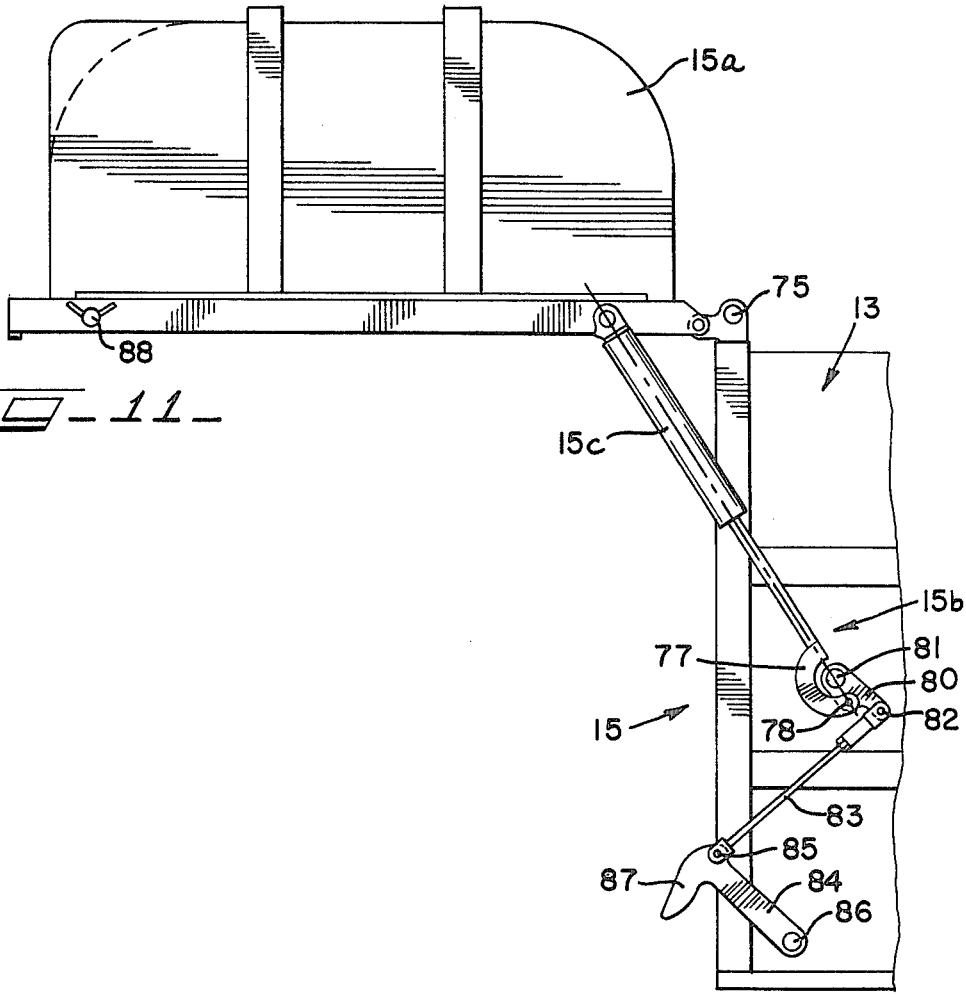
FIG. 11

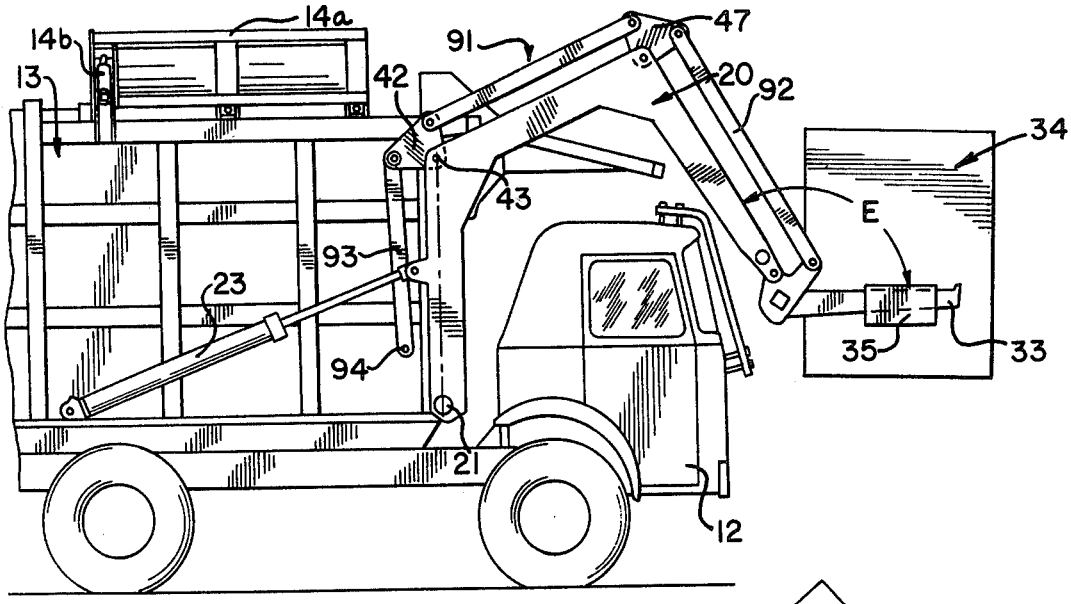
FIG. 12
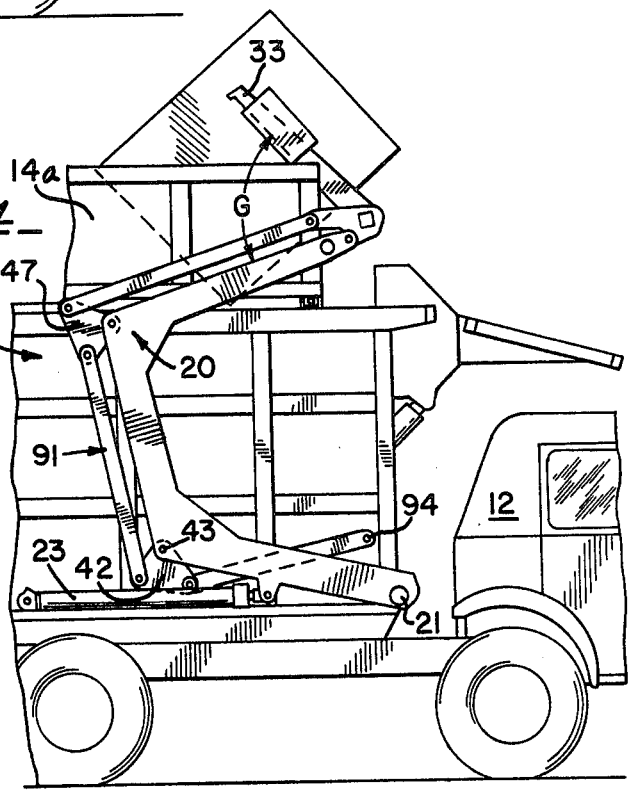
FIG. 14
FIG. 13
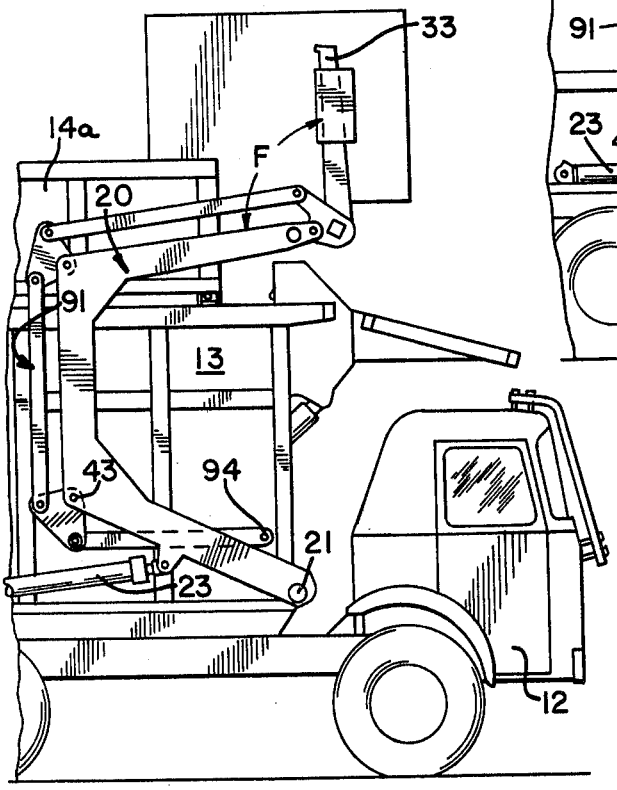

FRONT END LOADER REFUSE COLLECTION BODY

BACKGROUND OF THE INVENTION

This invention relates to front end loading refuse collection bodies for vehicles, and more particulary to improvements in the systems for loading and unloading refuse in such refuse collection bodies.

Refuse collection bodies are generally divided into two types. A rear-end loading refuse body is used where the refuse containers to be emptied are sufficiently small to enable a person to lift one into the opening of the refuse collection body on the vehicle. A second type, or front end loading refuse body, is utilized in connection with larger refuse containers which are, in most cases, rectangular in shape and have an open top, or a pivotally mounted cover extending across an open top of the container. In order to load the contents of the larger rectangular container into the refuse collection body, a pair of coacting arms are pivotally mounted to the front end of the body so as to extend forwardly of the vehicle driving cab when the arms are in a lowered position. Forks on the ends of the arms engage receptacles mounted on the sides of the refuse container. Then, the arms lift the container up over the vehicle cab to a position on top of the refuse collecting body where the contents of the container is deposited into the body through an opening in the top thereof.

Since such a refuse container has an open or openable top portion, it is a recognized problem in the industry to maintain refuse in a filled container while it is being lifted over the cab in a front loading refuse collection vehicle. Previous attempted solutions to this problem have included the addition of complex hydraulic machinery which automatically compensates for the rotational movement of the arms to maintain the container approximately horizontal while the arms are lifting it over the vehicle cab. Such a system is shown in U.S. Pat. No 3,827,587.

Also, since it is desirable for sanitary reasons to keep the refuse collection body closed, except when refuse is being put into or pushed out of it, doors covering the top opening in the body should open and close in connection with the operation of the container lifting arms. Further, a rear door on the refuse collection body, which is normally hingedly attached to the top rear of the body, should be automatically operable to unlock and open in cooperation with a hydraulic packing mechanism positioned inside the refuse collection body for unloading refuse therefrom.

SUMMARY OF THE INVENTION

Applicant solves the above mentioned problems by providing a front end loading refuse collection system for collecting and transporting refuse in a motor vehicle which includes a body adapted to receive the refuse through an opening therein. A pair of lifting arms of inverted U-shape are pivotally mounted at one of their ends to opposing sides of the body for coaction in vertical swinging movement beween a bottom position in which the free ends of the arms extend forwardly of the front of the body to a top position in which the free ends of the arms extend above the top of the body. A fork arm for engaging a refuse container is pivotally mounted to the free end of each lifting arm for vertical swinging movement from a position extending forwardly of the free end of each lifting arm when the lifting arms are in their bottom position, to a position extending rearwardly of the lifting arms when they are in their top position. The invention resides in am improvement comprising mechanical linkage means pivotally mounted to the body, the lifting arms, and the fork arms, for angularly moving the fork arms in a direction opposite the angular movement between the lifting arms and the body as the lifting arms move from their bottom position to a position mediate their bottom and top positions.

The invention is further directed to coactive operation between the means for operating the pair of lifting arms and a means for opening doors which cover the top opening in the refuse collection body. The doors open as the lifting arms move between their bottom and top positions and the doors are closed as the lifting arms move between their top and bottom positions.

The invention is further directed to a mechanical means for unlocking the rear door on the refuse collection body while, at the same time, hydraulically operating a power rear door opening mechanism.

It is therefore an object of the invention to provide a front end loading refuse collection body for a refuse collection vehicle wherein mechanical means are provided for maintaining a refuse container in a substantially upright position while the container is being raised over the top of the refuse collecting body to a position wherein the refuse in the container is to be dumped into an opening in the body.

Another object of the invention is the provision of automatically opening doors which cover the top opening of the refuse collection body as the refuse container is being lifted to a position over the opening.

A further object of the invention is the provision of a mechanical unlocking mechanism for the refuse body which unlocks a rear door therein as the door is being opened under hydraulic power.

BRIEF DESCRIPTION OF THE DRAWINGS

The features of the present invention, which are believed to be novel, are set forth with particularity in the appended claims. The invention may best be understood by reference to the following detailed description taken in connection with the accompanying drawings in the several figures of which like reference numerals identify like elements and in which:

FIG. 9 is a partial elevational view of the rear door unlocking and opening mechanism shown in FIG. 1;

FIG. 10 is a partial elevational view similar to that shown in FIG. 9 wherein the mechanical unlocking mechanism for the rear door has been unlatched;

FIG. 11 is a partial elevational view similar to that shown in FIG. 9 wherein the power door opening mechanism has opened the rear door of the refuse collecting body;

FIG. 12 is a partial elevational view of a modification of the container lifting mechanism, similar to that shown in FIG. 3, wherein the hydraulic fork cylinders are replaced by a simple mechanical linkage;

FIG. 13 is a partial elevational view similar to that shown in FIG. 12 wherein the modified container lifting mechanism is approaching its uppermost position; and FIG. 14 is a partial elevational view similar to that shown in FIG. 13 wherein the modified container lifting mechanism has achieved its uppermost position and the refuse in the container is being dumped into a refuse collecting body.

DETAILED DESCRIPTION OF THE INVENTION

Figure 1:
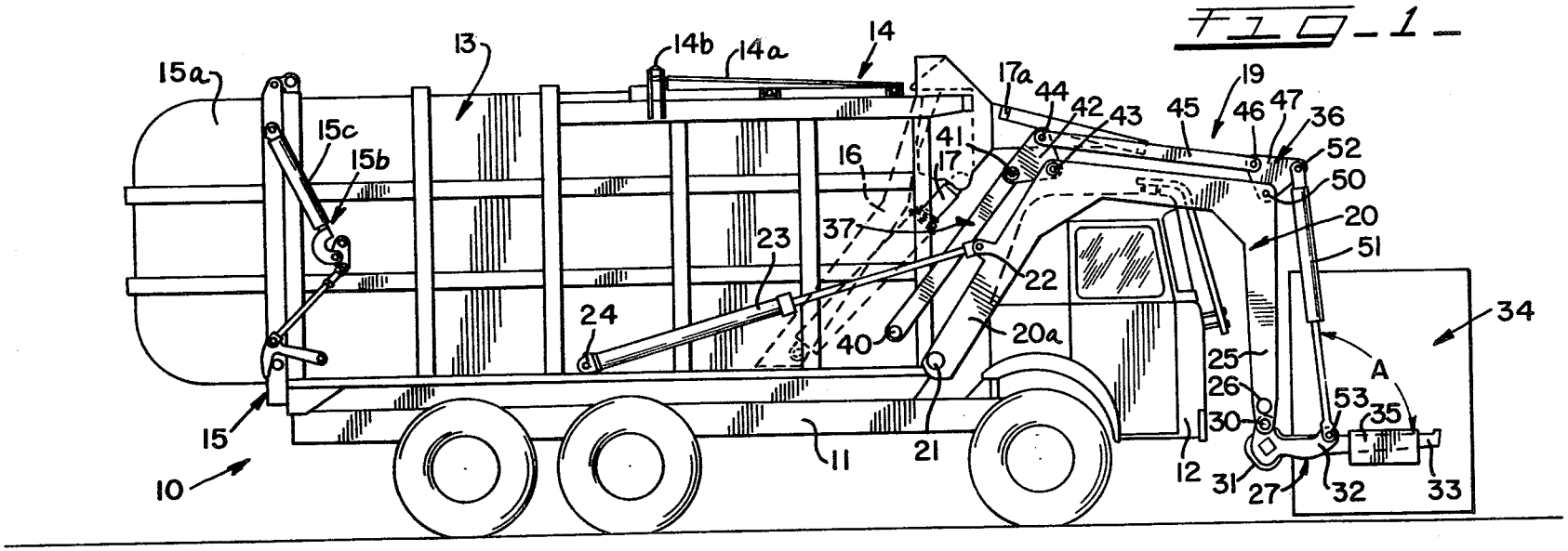
FIG. 1 is a plan view of a front end loading refuse collection vehicle constructed in accordance with the invention, wherein the lifting arms and forks thereon have engaged a refuse container.

Referring to FIG. 1, a front loading refuse collection vehicle is indicated generally at 10. The vehicle 10 includes a chassis 11 having a cab 12 mounted on the front thereof. Cab 12 is most commonly of the tilt-type which mounts above the engine (not shown) and tilts forward for access thereto. A refuse collection body, generally indicated at 13, is supported on the chassis 11 to the rear of cab 12 and includes a top opening, generally indicated at 14 through which refuse may be dumped into the interior of the body 13. Top opening 14 is covered by a pair of doors **14*a* hinged to opposing sides of body 13, and operated by hydraulic rams 14*b* pivotally mounted between the doors and the body. Body 13 also includes a back opening, generally indicated at 15, through which refuse may be dumped out of the body. Back opening 15 is covered by a large door 15*a* which is hingedly attached to the top of body 13. A door operating mechanism, generally indicated at 15*b*, unlocks the door and opens it by means of hydraulic ram 15*c*. A packer plate 16 is mounted in the interior of the body and is powered by hydraulic packer cylinder 17** for packing refuse toward the rear of the body.

Body 13 also includes a container lifting mechanism, generally indicated at 19. Lifting mechanism 19 includes a pair of refuse container lifting arms, generally indicated at 20 (one shown), which are mounted to body 13 for coactive vertical swinging movement by means of a torque tube 21 rigidly mounted to and extending between the rear distal ends **20*a* of the lifting arms. Torque tube 21 is rotatably mounted to body 13 and extends transversely across the bottom portion of the front thereof. Lifting arms 20 are of an inverted U-shape so as to provide access to the doors of cab 12 at all times. The forward distal ends 25 of the arms 20 extend forward of cab 12 when the lifting arms are in their lowermost position, as shown in FIG. 1. Each lifting arm 20 is pivotally mounted at 22 to the piston end of a hydraulic ram 23. The housing end of the hydraulic ram 23 is mounted to body 13 at pivotal mounting 24**.

Figure 2:
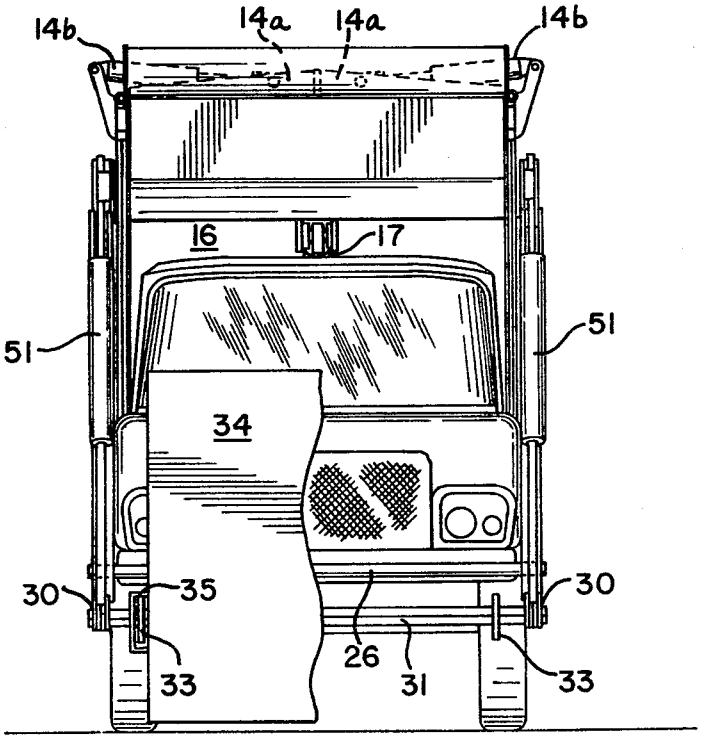
FIG. 2 is a front plan view of the refuse collection vehicle shown in FIG. 1.

Inwardly of the forward distal ends 25 of lifting arms 20, and between each such lifting arm is mounted a cross brace 26 which together with torque tube 21 provide space frame rigidity for cooperative coaction between the lifting arms 20. At each distal end 25 below cross bar 26, a fork arm mechanism, generally indicated at 27, is pivotally mounted at 30 (FIGS. 1 and 2). Fork arm mechanism 27 includes a cross beam 31 extending between the lifting arms, power transmitting arms 32 positioned at each end of cross-brace 31, and a pair of fork arms 33 positioned in spatial relation on cross beam 31 spatially inwardly of each power transmitting arm 32. The power transmitting arms 32 and fork arms 33 are positioned to extend forwardly of lifting arms 20 when the lifting arms are in their lowest position. The spatial relation between fork arms 33–33 is standardized to the dimensions of a substantially rectangular refuse container, generally indicated at 34, so as to be received in hollow channel receptacles 35 mounted on opposing sides of the container. When the fork arms 33 are positioned within receptacles 35, raising the lifting arms 20 by means of hydraulic rams 23 lifts the refuse container 34 over cab 12 until the contents of the container can be dumped through opening 14 in the body 13.

When lifting container 34 over cab 12, it is necessary to maintain the container in an approximate vertical position for a substantial portion of the lifting movement to avoid spilling the contents of the container before it is positioned over body top opening 14. In order to maintain container 34 in a sufficient semblance of verticality to prevent spillage of the contents thereof, the fork arm mechanism 27 is rotated in a clockwise direction during the first portion of the counter-clockwise rotation of the lifting arms 20.

Applicant's invention includes a pair of mechanical bell crank linkage mechanisms, generally indicated at 36 (one shown), which provide a proper amount of compensating reverse directional rotation for the fork mechanism 27 during the first portion of the lifting cycle of the lifting arms 20. Bell crank mechanism 36 is pivotally mounted at one end to the body 13, is pivotally mounted at two locations along the top of lifting arms 20, and is pivotally mounted to the fork arm mechanism 27.

Bell crank mechanism 36 includes a first simple linking arm 37 which is pivotally mounted at one end by mounting 40 to the refuse body 13. Pivotal mounting 40 is positioned above and to the rear of the pivotal mounting for torque tube 21 on lifting arms 20, the purpose of which will be discussed below. The opposing end of first link 37 is pivotally mounted at 21 to first bell crank member 42. Bell crank member 42 is triangular in shape, having pivotal mountings at each corner thereof, and is pivotally mounted at 43 to one corner of the bight portion of lifting arm 20. The remaining corner of bell crank 42 provides a pivotal mounting at 44 to one end of a second simple link 45. The opposing end of second link 45 is pivotally mounted at 46 to second bell crank member 47 which is triangularly shaped similar to first bell crank member 42. Second bell crank member 47 has pivotal mountings at each of its three corners and is pivotally mounted to the opposing corner of the bight portion of lifting arm 20 at 50.

A hydraulic ram 51 is the third link in the bell crank mechanism 36, and is pivotally mounted at its housing end at 52 to second bell crank 47, while being pivotally mounted at its piston end at 53 to the distal end of power transmitting arm 32. Unlike the prior art, in which extension and contraction of the hydraulic rams are used to provide a clockwise rotational movement to the fork arm mechanism during the counter-clockwise rotation of lift arms 20, the hydraulic rams 51 of applicant's invention are maintained in extended position during the lifting movement of arms 20. In other words, during the lifting portion of the container dump cycle, rams 51 act as simple connecting links.

Figure 6:
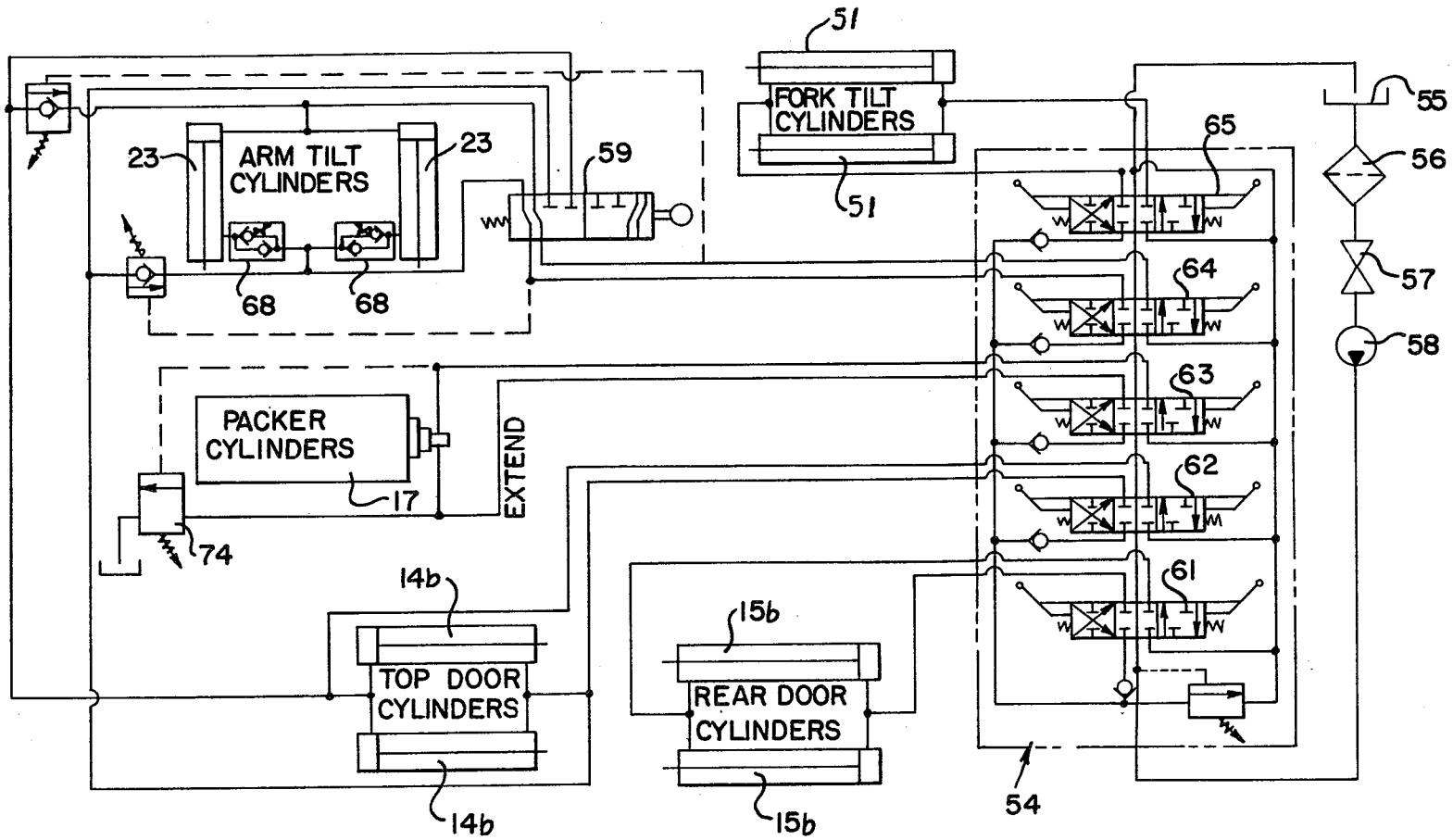
FIG. 6 is a schematic hydraulic circuit diagram for the front end loading refuse collection body of the invention.

A hydraulic circuit diagram for the entire body 13 is shown in FIG. 6. The refuse body 13 includes 5 basic hydraulic sub-systems, the arm tilt cylinders, the fork tilt cylinders, the packer cylinder, the top door cylinders, and the rear door cylinders. A five spool combination valve, generally indicated at 54, is utilized to control the hydraulic action of each of the five sub-systems. The system includes in-line a hydraulic reservoir 55, a filter 56, a shut-off valve 57, a pump 58, the five spool control valve 54, a valve 59 which opens the top doors as the lifting arm mechanism raises the container, and the various hydraulic rams and valving associated therewith in each of the five sub-systems.

A lifting cycle of the front loading refuse collection system is shown in FIGS. 1–5. As the vehicle 10 approaches a container 34, each of the five sub-system spools 61-65 in valve 54 in centrally positioned (FIG. 6). The vehicle 10 moves forward toward the container 34 until the fork arms 33 are positioned in channel retainers 35 in the position shown in FIG. 1.

Figure 3:
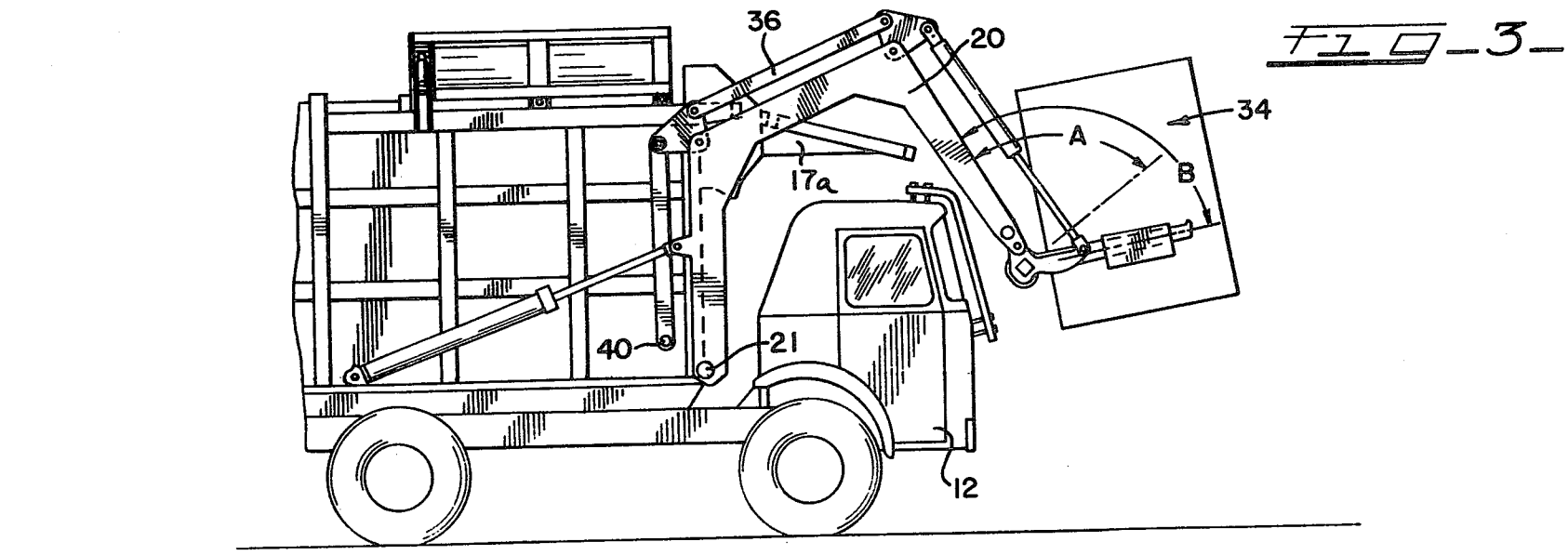
FIG. 3 is a partial elevational view, similar to that shown in FIG. 1, wherein the container lifting mechanism has started lifting the refuse container over the vehicle cab.

To start the lifting cycle, spool 64 is shifted to the left causing oil to flow into the piston ends of hydraulic rams 23. The pistons on rams 23 are retracted into their housing which causes rotation of the lifting arms 20 counter-clockwise around the mounting for torque tube 21. As the lifting arms 20 rotate counter-clockwise to lift container 34, the bell crank mechanism 36 moves forward relative the lifting arms, i.e., each of the bell cranks 42 and 47 move clockwise to impart a clockwise motion to lifting forks 33. The clockwise motion of the bell crank mechanism is dictated by the position of pivotal mounting 40. As shown in FIG. 3, as the container lifting mechanism 19 begins lifting the container 34 over the cab 12, the bell crank mechanism 36 increases the angular relation between the lifting arms 20 and lifting forks 33. The original angular relation is designated angle A in FIGS. 1 and 3 and approximates 90°. The increased angular relation, designated angle B in FIG. 3, is the resultant of the mechanical bell crank linkage 36 counteracting the rotational movement of lifting arms 20.

The bell crank mechanism 36 will continue to move clockwise relative the counter-clockwise movement of lifting arms 20 until the center-line between the torque tube 21 and first bell crank pivot point 33 passes a position where it is parallel with the first link 37. This purely mechanical relationship maintains container 34 in a sufficiently vertical position to avoid spilling refuse until the container is positioned over the body top opening 14.

At a specified position such as that shown in FIG. 3, a cam (not shown) on torque tube 21 shifts the spool on valve 59 to extend hydraulic oil to the piston side of top door cylinders 14*b* to open the top doors 14 a and uncover opening 14 as the container 34 is brought thereover. It should be noted that the container does not have to be precisely vertical during lifting. Also, if container 34 is filled to overflowing, some spillage is inevitable. Protective cover 17*a* shields cab 12 from spilled refuse.

Figure 4:
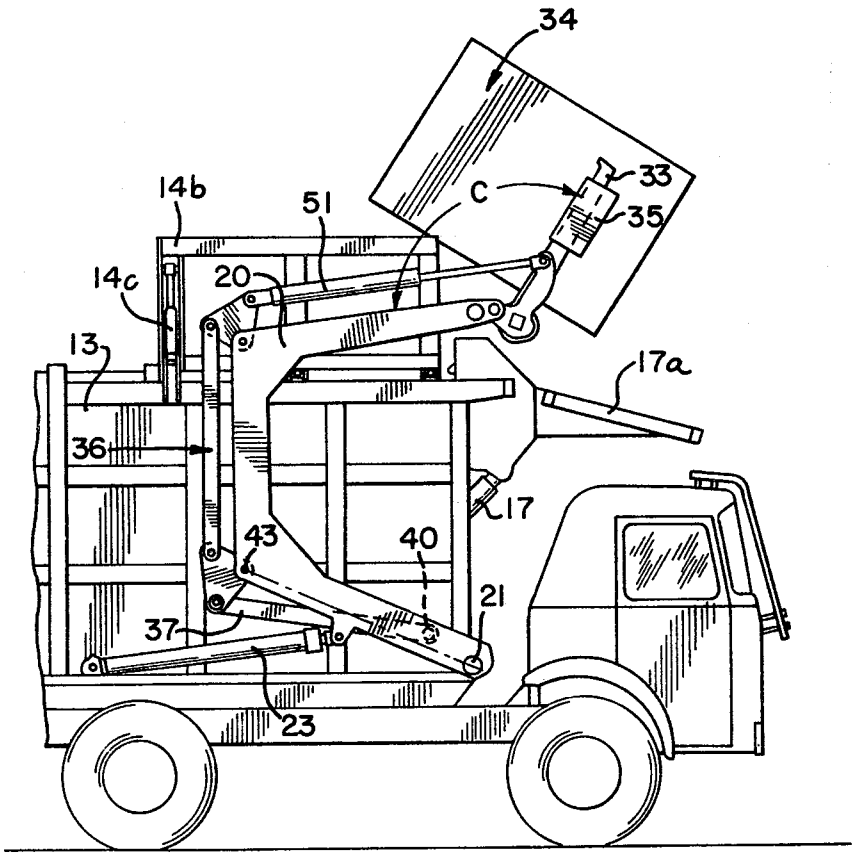
FIG. 4 is a partial elevational view similar to that shown in FIG. 3, wherein the container lifting mechanism is positioned in its topmost position.

Referring to FIG. 4, the container lifting mechanism 19 is shown in its highest position with arm lift cylinders 23 fully retracted. The top of container 34 is positioned over opening 14 and the contents of container 34 are ready to be dumped into body 13. The angle C between the lifting arm 20 and fork arm 33 is slightly smaller than the greatest angular relation which the mechanism has during the rotation of the lifting arms, and it is noted that the center-line between torque tube 21 and pivotal mounting 43 has just passed over the pivotal mounting 40 on first link 37. During this counter-clockwise motion and slight finishing counterclockwise motion of the lifting arms 20, hydraulic rams 51 have been utilized solely as simple linkages.

Figure 5:
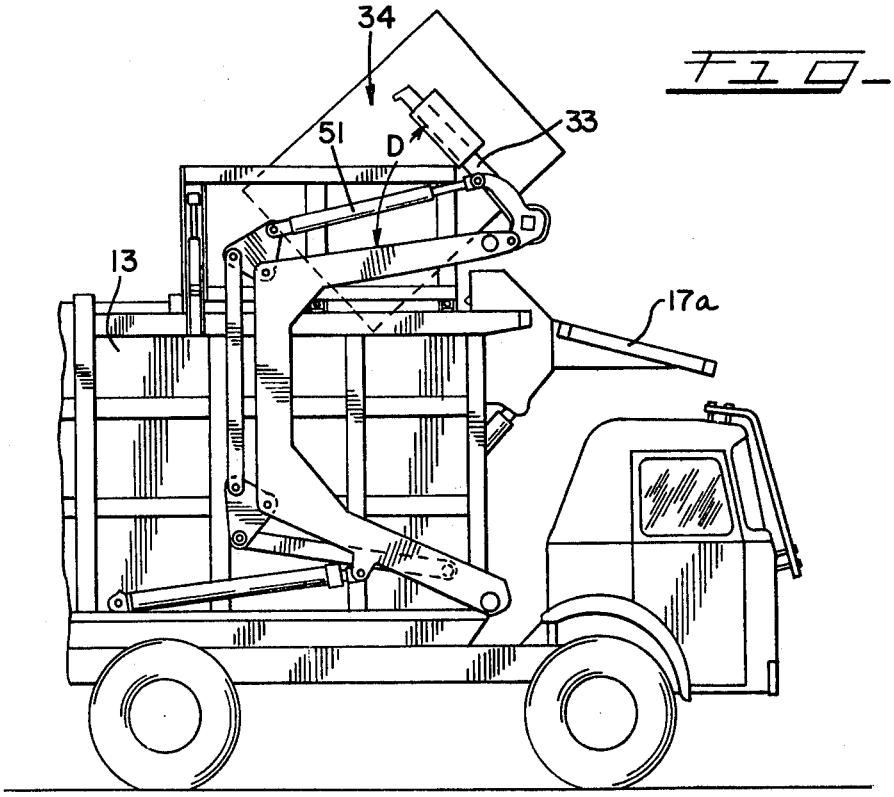
FIG. 5 is a partial elevational view similar to that shown in FIG. 4, wherein the container has been tilted to drop its contents into the open doors of the refuse collection body.

Referring to FIG. 5, once the lifting arms 20 reach their highest position, spool 65 in valve 54 is shifted to the left which causes oil to flow in the piston ends of rams 51. The length of rams 51 are shortened, thus rotating forks 33 counter-clockwise until angle D is reached, at which point the top of container 34 is inserted into opening 14 and the contents of the container are dumped into the body 13. After all the contents of the container 34 have fallen into body 13, spool 65 is pushed to the right and the cycle is reversed. When the fork arms 33 reach the position they are originally shown in in FIG. 4, spool 64 is pulled to the right and the lifting arms 20 are lowered as oil flows into the housing end of hydraulic rams 23. As the lifting arms return to the lowermost position shown in FIG. 1, the bell crank compensating mechanism 36 moves counter-clockwise relative the clockwise angular motion of lifting arms 20, which is the reverse of the action of the lifting phase. As the lifting arms 20 descend, the cam (not shown) on torque tube 21 moves off the spool on valve 59, a spring returns the spool to the first position shown in FIG. 6, and oil moves into the housing side of top door cylinders 14*b* automatically closing doors 14*a* over opening 14. Lifting arms 20 continue to descend until they reach their lowermost position. It should be noted that if spools 62 or 64 are accidently moved, lifting arms 20 might free fall except for the insertion of combination check and restriction valves 68–68 (FIG. 6) which restrict the unloading of rams 23.

Figure 8:
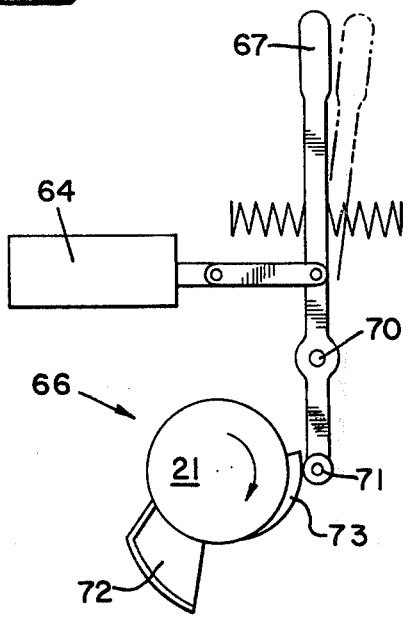
FIG. 8 shows a schematic diagram of the mechanical cam arrangement shown in FIG. 7 wherein the cam coacts with the hydraulic circuirty to deccelerate the movement of the lifting arms toward the end of their downward rotation.
Figure 7:
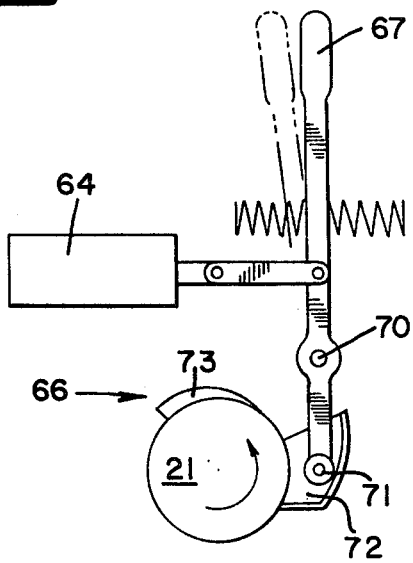
FIG. 7 is a schematic diagram of a mechanical cam arrangement which coacts with the hydraulic circuitry to deccelerate the movement of the lifting arms toward the end of their upward rotation.

In order to shorten lifting cycle times, it is desirable to speed the motion of container dumping mechanism 19 during the lifting and lowering phases of the container dumping cycle. However, some means of decelerating the rotational movement of the lifting arms is desirable before the arms reach their uppermost or lowermost movement positions, in order to avoid jarring the container lifting mechanism 19 at an abrupt end of each portion of the cycle. Referring to FIGS. 7 and 8, a second cam arrangement, generally indicated at 66, is shown as connected to torque tube 21 to perform this function.

The operating lever 67 is utilized to move spool 64 to the left and right in order to lift and lower the lifting arms 20, respectively. The operating lever is spring-loaded and pivotally mounted at 70 to body 13 (not shown) with a cam follower 71 positioned at the bottom end of the lever. In FIG. 7, as lever 67 and spool 64 are moved to the left to lift a refuse container, and as the torque tube 21 rotates counter-clockwise to a position where the lifting mechanism approaches the end of its upward rotation, a decelerating cam 72 fully and automatically moves spool 64 back to its central position, thus slowly cutting off the supply of oil to the rams 23. When operating arm 67 and spool 64 are moved to the right (FIG. 8), the lifting arms 20 move from the uppermost position down to the lowermost position. As the arms approach the lowermost position the deceleration cam 73 in torque tube 21 moves the cam follower 71 slowly but surely back to the central position so as to decelerate the downward movement of the lifting arms 20. The deceleration mechanism shown in FIGS. 7 and 8 provides for safe and efficient operation of the container lifting mechanism 19 while allowing high rates of upward and downward travel during the major portions of their cycles.

After the contents of container 34 have been dumped through opening 14 into body 13, spool 63 is shifted to the left and oil is moved into the housing end of packer cylinder 17 to push packer plate 16 (FIG. 1) toward the rear of body 13 thus packing the refuse tightly into the back of the body. Spool 63 is then pushed to the right and an unloading valve 74 opens to dump oil into the tank while pumping oil into the piston end of packer ram 17. This system is utilized because much less pressure is needed to move packer plate 16 forward than to extend ram 17 when packing the refuse to the back of body 13.

Referring to FIGS. 9, 10, and 11 in conjunction with FIG. 6, after the body 13 is filled with refuse, the vehicle 10 is moved to a suitable dumping site. In order to dump the refuse from body 13, rear door 15*a* which is hingedly connected to the top of body 13 at 75 is unlocked and hydraulically opened by a pair of rear door operating mechanisms, generally indicated at 15*b* (one shown). As shown in FIG. 9, each rear door operating mechanism 15*b* includes a hydraulic ram 15*c* which has its housing end pivotally mounted at 76 to back door 15*a*. The piston end of ram 15*c* includes a semi-circular shaped portion 77, the function of which is described below. A pivotal mounting 78 at the distal end of semi-circular portion 77 mounts the ram to a bell crank mechanism 80, which is pivotally mounted at 81 to the side of body 13. A third pivotal mounting 82 on bell crank 80 provides a mounting for a connecting link 83 which is connected to a latching mechanism 84 at pivotal mounting 85. Latching mechanism 84 is pivotally mounted at 86 to body 13 and includes a hooked distal end 87 which is capable of extending over locking pin 88 on door 15*a* so as to lock the door over rear opening 15 of body 13.

In operation, as spool 61 (FIG. 6) is shifted to the left, oil flows into the housing end of hydraulic ram 15*c* extending the piston end thereof. Since the piston end of hydraulic ram 15*c* is not directly pivotally mounted to body 13, door 15*a* does not begin to open as soon as hydraulic ram 15*c* is energized. Rather, the extension outwardly of the piston of ram 15*c* causes bell crank 80 to rotate counter-clockwise around its mounting 81 until the center line of the ram extends through pivotal mounting 81. When the bell crank 80 reaches this center line position, the pivotal mounting 78 is positioned diametrically opposite the major portion of ram 15*c* from mounting 81. This counter-clockwise rotation of bell crank 80 acts through connecting link 83 to unlatch the locking arm 84 from door 15*a* thus unlocking the door and allowing it to be opened, as shown in FIG. 10. As soon as bell crank 80 reaches the position shown in FIG. 10, pivotal mounting 81 restrains further movement of the piston end of the ram such that the ram housing extends outwardly from the piston as oil flows into the housing end thereof. The ram housing then moves the door 15*a* in a clockwise manner until it is fully opened as is shown in FIG. 11. Once the rear door is fully opened, spool 63 is shifted to the left and the packer cylinder 17 extends thus moving packer plate 16 through body 13 rearwardly until all the refuse in the body 13 is pushed out of rear door 15. Spool 63 is then shifted to the right to reverse the movement of packer plate 16. Next, spool 61 is shifted to the right to close and lock door 15*a*.

Referring to FIGS. 12, 13, and 14, a modification of the bell crank compensating mechanism of the invention is shown, generally indicated at 91 in FIG. 12. The portions of bell crank mechanism 36 which are not changed in the second embodiment are shown with the identifying numbers used in the first embodiment. FIG. 12 closely resembles the position of the lifting arms 20 as shown in FIG. 3 of the first embodiment. The differences in the bell crank compensating mechanism 91 from that of the first embodiment includes substituting a simple link 92 for hydraulic ram 51 of the first embodiment, and substituting a shorter first simple link 93 for first link 37 of the first embodiment. Pivotal mounting 94, at which point link 93 is mounted to the side of body 13, is moved upwardly and forwardly of the original pivotal mounting 40, shown in the first embodiment. When the lifting arms 20 are rotated counter-clockwise around torque tube pivot 21, bell crank compensating mechanism 91 moves clockwise relative the lifting arm until the center-line between pivot points 43, and 21 moves over pivotal mounting 94. During counter-clockwise rotation of lifting arms 20, the angular relation between fork arms 33 and lifting arms 20 enlarges from right angular to obtuse, as shown by angle E. Once the center-line between pivot points 43 and 21 moves past a parallel position with first link 37 in a counter-clockwise direction, as shown in FIG. 13, the relative angular movement between the bell crank compensating mechanism 91 and lifting arms 20 reverses, i.e., the bell cranks 42, 47 rotate counter-clockwise at a faster rate than lifting arms 20 do. As shown in FIG. 13, lifting arm 20 has moved past pivotal mounting 94 and the bell crank mechanism 91 has reversed its rotational movement to a position where angle F between the lifting arms 20 and fork arms 33 has returned to approximate a right angle.

As shown in FIG. 14, the lifting arm 20 has progressed counter-clockwise to its maximum extent, sufficiently past pivotal mounting 94 that the bell crank mechanisms 91 have accelerated the counter-clockwise rotation of fork arms 33 until the angle between lifting arm 20 and fork arm 33, denoted by angle G, is acute and approximates angle D of the first embodiment shown in FIG. 5. Thus, in one counter-clockwise upward movement of the lifting arms 20, the modified bell crank compensating mechanism 91 has, during the first portion of the lifting phase, reversed the counter-clockwise movement of the lifting arms in relation to the fork arms and has, during the second part of the lifting phase, reversed itself to accelerate the counter-clockwise movement of the fork arms in relation to the lifting arms. This action of the modified bell crank compensating system 91 acts to maintain container 34 substantially upright until the lifting arms 20 reach a fairly high position, at which time the mechanism automatically reverses and acts to dump the contents of container 34 into the opening 14 without the need for the hydraulic rams 51 shown in the first embodiment. The remainder of the second embodiment of the front loading refuse collection system is substantially identical to that utilized in the first embodiment. Thus, applicant's invention provides a greatly simplified front-loading refuse collection system which has substituted mechanical components for complex and expensive hydraulic components utilized in the prior art, while providing for safe, efficient refuse collection in a front-loading refuse collection system.

While one particular type of hydraulic circuit has been shown, it will be appreciated that other types of circuit arrangements can be used as well. Furthermore, the invention can be practiced with other types of linkages and cylinder arrangements and with other sizes and shapes of refuse hoppers.

While two particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

I claim:

1. In a front-end loading refuse collection system for collecting and transporting refuse in a motor vehicle, said system including in combination:

a body adapted to receive refuse through an opening therein;

a pair of lifting arms pivotally mounted to opposing sides of said body for coacting in vertical swinging movement between a bottom position in which the free ends of said arms extend forwardly of the front of said body to a top position in which the free ends of said arms extend above the top of said body, each said lifting arm generally being curved and including a concavely curved bottom surface defining an open area beneath said arm for providing user access to said motor vehicle regardless of the operating position of said lifting arm;

a pair of fork arms, one form arm pivotally mounted on the free end of each lifting arm, for coacting in vertical swinging movement from a position extending forwardly of the free ends of said lifting arms when in said bottom position to a position extending rearwardly of the free ends of said lifting arms when in said top position; and an improvement comprising:

mechanical linkage means including a pair of linkages, each pair including a plurality of operatively connected linking members pivotally mounted adjacent one end thereof, to said body and pivotally mounted adjacent an opposing end thereof to the respective ones of said fork arms, said linkages further being operatively connected on at least one pivot point on the respective ones of said lifting arms and positioned therealong to generally follow the curvature thereof, said linkage means angularly moving said fork arms in a direction opposite the angular movement between said lifting arms and said body as said lifting arms move from said bottom position to a position adjacent said top position thereof; and said mechanical linkage means reversing the angular movement of said fork arms to the same direction as the angular movement of said lifting arm as said lifting arms move from said position adjacent said top position to said top position, said reversal of angular movement commencing as a line between said lifting arm pivotal mounting on said body and the closest adjacent linkage means pivot point on said lifting arm angularly moves across the axis of said linkage pivotal mounting on said body.

2. The refuse collection system of claim 1 wherein said mechanical linkage means include:

a bell crank member mounted for vertical swinging movement to one of said lifting arms at a position mediate the ends thereof; and wherein said plurality of linking members include:

a first linking member pivotally mounted at one end thereof to said body and pivotally mounted at an opposing end thereof to said bell crank member; and a second linking member pivotally mounted at one end thereof to said bell crank member and pivotally mounted at an opposing end thereof to said lifting fork mounted to said one lifting arm.

3. The refuse collection system of claim 2 wherein said second linking member includes a power-operated hydraulic cylinder which is energized in a standard operating mode for tilting said fork arms only when said lifting arms are substantially in said top position.

4. The front-end loading refuse collection system of claim 1 further including a mechanical unlatching linkage for coacting with a hydraulic ram to automatically unlatch and open a door which is hingedly attached to said body over a rear opening therein, said mechanical unlatching linkage being pivotally mounted to said ram and said body and being adapted to be maintained in a movable position of pivotal equilibrium around said pivotal mounting after said door is unlatched and while said door is being opened by said ram.

5. The front-end loading refuse collection system of claim 1 further including:

an automatically operated door system for covering said opening in said body, said door system including a pair of doors positioned across said opening, and hingedly attached to opposing sides of said opening, said door system being adapted to move said doors upwardly and outwardly of said body to uncover said opening as said lifting arms move upwardly from said bottom position, and adapted to move said doors to cover said opening as said lifting arms move downwardly from said top position.

6. In a refuse collection vehicle including:

a chassis;

a cab mounted on the front end of the chassis; and a front end loading refuse collection system mounted on said chassis to the rear of said cab, said system including:

a body adapted to receive refuse through an opening therein;

a pair of lifting arms pivotally mounted to opposing sides of said body for coacting in vertical swinging movement between a bottom position in which the free ends of said arms extend forwardly of the front of said body to a top position in which the free ends of said arms extend above the top of said body, each said lifting arm generally being curved and including a concavely curved bottom surface defining an open area beneath said arm for providing user access to said motor vehicle cab regardless of the operating position of said lifting arm;

a pair of fork arms, one fork arm pivotally mounted on the free end of each lifting arm, for coacting in vertical swinging movement from a position extending forwardly of the free ends of said lifting arms when in said bottom position to a position extending rearwardly of the free ends of said lifting arms when in said top position; and an improvement comprising:

mechanical linkage means including a pair of linkages, each pair including a plurality of operatively connected linking members pivotally mounted adjacent one end thereof, to said body and pivotally mounted adjacent an opposing end thereof to the respective ones of said fork arms, said linkages further being operatively connected on at least one pivot point on the respective ones of said lifting arms and positioned therealong to generally follow the curvature thereof, said linkage means angularly moving said fork arms in a direction opposite the angular movement between said lifting arms and said body as said lifting arms move from said bottom position to a position adjacent said top position thereof, and said mechanical linkage means reversing the angular movement of said fork arms to the same direction as the angular movement of said lifting arms as said lifting arms move from said position adjacent said top position to said top position, said reversal of angular movement commencing as a line between said lifting arm pivotal mounting on said body and the closest adjacent linkage means pivot point on said lifting arm angularly moves across the axis of said linkage pivotal mounting on said body.

7. The refuse collection vehicle of claim 6, wherein said mechanical linkage means include:

a bell crank member mounted for vertical swinging movement to one of said lifting arms at a position mediate the ends thereof; and wherein said plurality of linking members include;

a first linking member pivotally mounted at one end thereof to said body and pivotally mounted at an opposing end thereof to said bell crank member; and a second linking member pivotally mounted at one end thereof to said bell crank member and pivotally mounted at an opposing end thereof to said lifting fork mounted to said one lifting arm.

8. The refuse collection vehicle of claim 7 wherein said second linking member includes a power-operated hydraulic cylinder which is energized in a standard operating mode for tilting said fork arms only when said lifting arms are substantially in said top position.

9. The front-end loading refuse collection vehicle of claim 6 further including:

a mechanical unlatching linkage for coacting with a hydraulic ram to automatically unlatch and open a door which is hingedly attached to said body over a rear opening therein, said mechanical unlatching linkage being pivotally mounted to said ram and said body and being adapted to be maintained in a variable position of pivotal equilibrium around said pivotal mounting after said door is unlatched and while said door is being opened by said ram.

10. The front-end loading refuse collection system of claim 6 further including:

an automatically operated door system for covering said opening in said body, said door system including a pair of doors positioned across said opening, said door system being adapted to move said doors upwardly and outwardly of said body to uncover said opening as said lifting arms moves upwardly from said bottom position, and adapted to move said doors to cover said opening as said lifting arms move downwardly from said top position.

11. The front-end loading refuse collection system of claim 1 wherein a torque tube extends between and joins said pair of lifting arms, and said torque tube includes cam actuation means positioned thereon for gradually deccelerating the movement of said hydraulic ram as said arms approach said top and bottom positions.

12. The front-end loading refuse collection system of claim 4 wherein said cam actuation means include a curved ramp member having a portion thereof extending radially spirally outwardly of said tube.

13. The front-end loading refuse collection system of claim 6 wherein a torque tube extends between and joins said pair of lifting arms, and said torque tube includes cam actuation means positioned thereon for gradually deccelerating the movement of said hydraulic ram as said arms approach said top and bottom positions.

14. The front-end loading refuse collection system of claim 13 wherein said cam actuation means include a curved ramp member having a portion thereof extending radially spirally outwardly of said tube.

15. In a front-end loading refuse collection system for collecting and transporting refuse in a motor vehicle, said system including in combination:

a body adapted to receive refuse through an opening therein;

a pair of lifting arms pivotally mounted to opposing sides of said body by a torque tube extending between said arms for coacting in vertical swinging movement between a bottom position in which the free ends of said arms extend forwardly of the front of said body to a top position in which the free ends of said arms extend above the top of said body;

a hydraulic ram pivotally mounted on said body and said lifting arms for moving said arms between said top and said bottom positions;

a pair of fork arms, one fork arm pivotally mounted on the free end of each lifting arm, for coacting in vertical swinging movement from a position extending forwardly of the free ends of said lifting arms when in said bottom position to a position extending rearwardly of the free ends of said lifting arms when in said top position; a door hingedly attached to the rear of said body for covering a rear opening therein; and an improvement comprising:

a hydraulic ram pivotally mounted at one end to said door at a first pivot, a first link pivotally mounted on said body at a second pivot, a link and latch means operatively connected to said first link to latch and unlatch said door corresponding to the position of said first link, the other end of said hydraulic cylinder being pivotally connected to said first link at a third pivot, whereby, the ram is initially extended to align said first, second and third pivots and when this alignment is reached, the door is in an unlatched state, and then said ram is further extended to pivotally open said door with said first, second and third pivots remaining in alignment during said opening.

16. In a front-end loading refuse collection system for collecting and transporting refuse in a motor vehicle, said system comprising in combination:

a body adapted to receive refuse through an opening therein;

a pair of lifting arms pivotally mounted to opposing sides of said body for coacting in vertical swinging movement between a bottom position in which the free ends of said arms extend forwardly of the front of said body to a top position in which the free ends of said arms extend above the top of said body;

a pair of fork arms, one fork arm pivotally mounted on the free end of each lifting arm, for coacting in vertical swinging movement from a position extending forwardly of the free ends of said lifting arms when in said bottom position to a position extending rearwardly of the free ends of said lifting arms when in said top position;

a door hingedly attached to the rear of said body for covering a rear opening therein; and an improvement comprising:

an operator operated control lever means for manually controlling the amount of hydraulic fluid to actuate said hydraulic ram, a first and second cam means on said torque tube for contacting said lever as said arms approach said top and bottom positions respectively and thereby moving said lever without manual intervention to control the amount of hydraulic fluid to said hydraulic ram to gradually decelerate the movement of said hydraulic ram as said top and bottom positions are approached.

* * * * *

UNITED STATES PATENT AND TRADEMARK OFFICE

CERTIFICATE OF CORRECTION

PATENT NO. : 4,091,944

DATED : May 30, 1978

INVENTOR(S) : Cyril R. Gollnick

It is certified that error appears in the above-identified patent and that said Letters Patent are hereby corrected as shown below:

ABSTRACT - LINE 8
"form" should be --fork--

COLUMN 2 - LINE 3
"am" should be --an--

COLUMN 3 - LINE 5
"Circuirty" should be --circuitry--

COLUMN 5 - LINE 27
"in" should be --is--

COLUMN 9 - LINE 40
"form" should be --fork--

COLUMN 11 - LINE 39
";" should be --:--

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*